US005456820A

United States Patent [19]

Forbus, Jr. et al.

[11] Patent Number: 5,456,820

[45] Date of Patent: Oct. 10, 1995

[54] CATALYTIC DEWAXING PROCESS FOR PRODUCING LUBRICATING OILS

[75] Inventors: Thomas R. Forbus, Jr., Newtown, Pa.; David S. Shihabi, Pennington, N.J.; Chwan P. Kyan, Mantua, N.J.; Robert W. Bortz, Woodbury Heights, N.J.; Rene B. LaPierre, Medford, N.J.

[73] Assignee: Mobil Oil Corporation, Fairfax, Va.

[21] Appl. No.: 812,312

[22] Filed: Dec. 23, 1991

Related U.S. Application Data

[63] Continuation-in-part of Ser. No. 728,752, Jul. 8, 1991, abandoned, which is a continuation of Ser. No. 544,088, Jun. 27, 1990, abandoned, which is a continuation of Ser. No. 359,605, Jun. 1, 1989, abandoned.

[51] Int. Cl.[6] ..... C10G 47/16

[52] U.S. Cl. ..... 208/111; 208/97

[58] Field of Search ..... 208/111, 97

[56] References Cited

U.S. PATENT DOCUMENTS

| | | | |
|---|---|---|---|
| 3,700,585 | 10/1972 | Chen | 208/111 |
| 3,968,024 | 7/1976 | Gorring et al. | 208/111 |
| 3,980,550 | 9/1976 | Gorring et al. | 208/111 |
| 3,989,617 | 11/1976 | Yan | 208/18 |
| 4,137,148 | 1/1979 | Gillespie et al. | 208/111 |
| 4,181,598 | 1/1980 | Gillespie | 208/18 |
| 4,222,855 | 9/1980 | Pelrine | 208/18 |
| 4,259,170 | 3/1981 | Graham | 208/111 |
| 4,376,036 | 3/1983 | Garwood | 208/111 |
| 4,414,097 | 11/1983 | Chester | 208/111 |
| 4,437,975 | 3/1984 | Gillespie et al. | 208/87 |
| 4,437,976 | 3/1984 | Oleck et al. | 208/111 |
| 4,446,007 | 5/1984 | Smith | 208/111 |
| 4,549,955 | 10/1985 | Shih | 208/59 |
| 4,574,043 | 3/1986 | Chester et al. | 208/111 |
| 4,872,968 | 10/1989 | Bowes | 208/111 |

*Primary Examiner*—Helane Myers

*Attorney, Agent, or Firm*—Alexander J. McKillop; Dennis P. Santini; Laurence P. Hobbes

[57] ABSTRACT

A process for making a lubricant oil of low pour point which comprises a) catalytically dewaxing a lube boiling range feedstock in the presence of hydrogen over a dewaxing catalyst comprising an intermediate pore size zeolite in the hydrogen or decationized form during a dewaxing cycle in which the temperature is progressively increased to maintain a substantially constant product pour point to produce a lubricant oil product of improved oxidation stability. The feedstock is sequenced during a dewaxing cycle from a heavy feed to a lighter feed in order to avoid contacting the lighter feed with the catalyst in its most active conditions.

13 Claims, 7 Drawing Sheets

CATALYTIC DEWAXING PROCESS FOR PRODUCING LUBRICATING OILS

CROSS-REFERENCE TO RELATED APPLICATIONS

This application is a continuation-in-part of application Ser. No. 07/728,752, filed Jul. 8, 1991 now abandoned by T. R. Forbus and C. P. Kyan which is a continuation of Ser. No. 544,088, filed Jun. 27, 1990 now abandoned, which in turn is a continuation of Ser. No. 359,605, filed Jun. 1, 1989 now abandoned.

FIELD OF THE INVENTION

The present invention relates to a catalytic dewaxing process for the production of low pour point lubricants, especially turbine oils.

BACKGROUND OF THE INVENTION

Mineral oil lubricants are derived from various crude oil stocks by a variety of refining processes directed towards obtaining a lubricant base stock of suitable boiling point, viscosity, viscosity index (VI) and other characteristics. Generally, the base stock will be produced from the crude oil by distillation of the crude in atmospheric and vacuum distillation towers, followed by the separation of undesirable aromatic components and finally, by dewaxing and various finishing steps. Because aromatic components lead to high viscosity and extremely poor viscosity indices, the use of asphaltic type crudes is not preferred as the yield of acceptable lube stocks will be extremely low after the large quantities of aromatic components contained in the lubestocks from such crudes have been separated out; paraffinic and naphthenic crude stocks will therefore be preferred but aromatic separation procedures will still be necessary in order to remove undesirable aromatic components. In the case of the lubricant distillate fractions, generally referred to as the neutrals, e.g. heavy neutral, light neutral, etc., the aromatics will be extracted by solvent extraction using a solvent such as furfural, N-methyl-2-pyrrolidone, phenol or another material which is selective for the extraction of the aromatic components. If the lube stock is a residual lube stock, the asphaltenes will first be removed in a propane deasphalting step followed by solvent extraction of residual aromatics to produce a lube generally referred to as bright stock. In either case, however, a dewaxing step is normally necessary in order for the lubricant to have a satisfactorily low pour point and cloud point, so that it will not solidify or precipitate the less soluble paraffinic components under the influence of low temperatures.

A number of dewaxing processes are known in the petroleum refining industry and of these, solvent dewaxing with solvents such as methylethylketone (MEK), a mixture of MEK and toluene or liquid propane, has been the one which has achieved the widest use in the industry. Recently, however, catalytic dewaxing processes have entered use for the production of lubricating oil stocks and these processes possess a number of advantages over the conventional solvent dewaxing procedures. These catalytic dewaxing processes are generally similar to those which have been proposed for dewaxing the middle distillate fractions such as heating oils, jet fuels and kerosenes, of which a number have been disclosed in the literature, for example, in *Oil and Gas Journal,* Jan. 6, 1975, pp. 69–73 and U.S. Pat. Nos. RE 28,398, 3,956,102 and 4,100,056. Generally, these processes operate by selectively cracking the normal and slightly branched paraffins to produce lower molecular weight products which may then be removed by distillation from the higher boiling lube stock. A subsequent hydrotreating step may be used to stabilize the product by saturating lube boiling range olefins produced by the selective cracking which takes place during the dewaxing. Reference is made to U.S. Pat. Nos. 3,894,938 and 4,181,598 for descriptions of such processes.

The catalysts which have been proposed for these dewaxing processes have usually been zeolites which have a pore size which admits the straight chain, waxy n-paraffins either alone or with only slightly branched chain paraffins but which exclude more highly branched materials and cycloaliphatics. Intermediate pore size zeolites such as ZSM-5, ZSM-11, ZSM-12, ZSM-22, ZSM-23, ZSM-35, ZSM-38 and the synthetic ferrierites have been proposed for this purpose in dewaxing processes, as described in U.S. Pat. Nos. 3,700,585 (Re 28398); 3,894,938; 3,933,974; 4,176,050; 4,181,598; 4,222,855; 4,259,170; 4,229,282; 4,251,499; 4,343,692, and 4,247,388. A dewaxing process employing synthetic offretite is described in U.S. Pat. No. 4,259,174. Processes of this type have become commercially available as shown by the 1986 Refining Process Handbook, page 90, Hydrocarbon Processing, September 1986, which refers to the availability of the Mobil Lube Dewaxing Process (MLDW). The MLDW process is also described in Chen et al "Industrial Application of Shape-Selective Catalysis" *Catal. Rev.-Sci. Eng.* 28 (283), 185–264 (1986), especially pp. 241–247, to which reference is made for a further description of the process. Reference is made to these disclosures for a description of various catalytic dewaxing processes.

In the catalytic dewaxing processes of this kind, the catalyst becomes progressively deactivated as the dewaxing cycle progresses and to compensate for this, the temperature of the dewaxing reactor is progressively raised in order to meet the target pour point for the product. There is a limit, however, to which the temperature can be raised before the properties of the product, especially oxidation stability become unacceptable. For this reason, the catalytic dewaxing process is usually operated in cycles with the temperature being raised in the course of the cycle from a low start-of-cycle (SOC) value, typically about 500° F. (about 260° C.), to a final, end-of cycle (EOC) value, typically about 680° F. (about 360° C.), after which the catalyst is reactivated or regenerated for a new cycle. Typically, the catalyst may be reactivated by hydrogen stripping several times before an oxidative regeneration is necessary as described in U.S. Pat. Nos. 3,956,102; 4,247,388 and 4,508,836 to which reference is made for descriptions of such hydrogen reactivation procedures. Oxidative regeneration is described, for example, in U.S. Pat. Nos. 4,247,388; 3,069,363; 3,956,102 and G.B. Patent No. 1,148,545. It is believed that the hydrogen reactivation procedure occurs by transfer of hydrogen to the coke on the deactivated catalyst to form more volatile species which are then stripped off at the temperatures used in the process.

The use of a metal hydrogenation component on the dewaxing catalyst has been described as a highly desirable expedient, both for obtaining extended dewaxing cycle durations and for improving the reactivation procedure even though the dewaxing reaction itself is not one which required hydrogen for stoichiometric balance. U.S. Pat. No. 4,683,052 discloses the use of noble metal components e.g. Pt, Pd as superior to base metals such as nickel for this purpose. During the dewaxing cycle itself, nickel on the catalyst was thought to reduce the extent of coke lay-down by promoting transfer of hydrogen to coke precursors formed on the catalyst during the dewaxing reactions. Similarly, the metal was also thought to promote removal of coke and coke precursors during hydrogen reactivation by promoting hydrogen transfer to these species to form materials which would be more readily desorbed from the catalyst. Thus, the presence of a metal component was considered necessary for extended cycle life, especially after hydrogen reactivation.

SUMMARY OF THE INVENTION

It has now been found, contrary to expectation, that the presence of a metal hydrogenation component in the dewaxing catalyst is not necessary for securing adequate cycle duration either on the first or subsequent cycles. In fact, it has been found that improvements in cycle duration both in the first and subsequent cycles may be obtained by using the zeolite on the dewaxing catalyst in its hydrogen or "decationized" form. In addition, the use of the hydrogen form zeolite leads to improvements in the quality of the lube product, especially its oxidative stability.

It has also been found that the effectiveness of hydrogen reactivation of dewaxing catalyst in its hydrogen or decationized form is improved where the feedstock is sequenced from heavier to lighter feeds prior to hydrogen reactivation for dewaxing catalyst. Such a benefit is not observed where metal hydrogenation component, e.g., Ni, is present in the dewaxing catalyst.

The present invention also relates to a process for making a lubricant oil of low pour point and improved oxidation stability from lube boiling range feedstock which comprises a) catalytically dewaxing a relatively heavy lube boiling range feedstock characterized by a 50% boiling point of greater than 850° F. and a kinetic viscosity at 100° C. of greater than 9 centistokes in the presence of hydrogen over a dewaxing catalyst comprising an intermediate pore size zeolite in the hydrogen or decationized form, during a dewaxing cycle in which the temperature is progressively increased to maintain a substantially constant product pour point; b) thereafter catalytically dewaxing a relatively light distillate lube boiling range feedstock characterized by a 50% boiling point of less than about 850° F. and a kinetic viscosity at 100° C. of less than 9 centistokes in the presence of hydrogen over said dewaxing catalyst; c) thereafter hydrogen reactivating said dewaxing catalyst; and d) repeating a) to c) at least once.

According to the present invention there is therefore provided a process for producing lubricant oils of low pour point and improved oxidation stability by catalytically dewaxing a lube boiling range feedstock uses an intermediate pore size zeolite as the dewaxing catalyst in the hydrogen or decationized form i.e. which does not contain a metal hydrogenation component. The process is characterized by the notably low aging rate achieved over the course of each dewaxing cycle. The aging rate is determined in the conventional manner, as the temperature increase required to maintain a product of selected pour point. In the present process the cumulative aging rate over the course of the dewaxing cycle is less than 4° F./day (about 2° C./day) in at least the first cycle with comparable rates being obtained in subsequent cycles. In addition, it has been found that the present dewaxing catalysts exhibit a trend towards line-out behavior, that is, they asymptotically approach equilibrium processing as the dewaxing cycle progresses—a very low aging rate is achieved during the later portions of the cycle. Typically, the aging rate falls to less than 1° F./day (about 0.5° C./day) during the latter portion of the cycle, typically at dewaxing temperatures above about 650° F. (about 345° C.).

The dewaxing process is typically carried out at temperatures from about 500° F. to about 750° F. (about 260° to about 400° C.) but the improvements in the oxidation stability of the product will be most notable at temperatures above about 620° F. (about 325° C.), especially above about 630° F. (about 330° C.). The oxidation stability of the product may also be enhanced by control of the conditions in the hydrotreatment following the dewaxing step, for example, by use of a relatively mild hydrogenation function such as molybdenum rather than the stronger functions such as cobalt-molybdenum which tend to remove the sulfur, especially aliphatic sulfur, compounds to an excessive degree. The improvements in oxidation stability are particularly notable in turbine oil products where this characteristic is of especial importance. The ability to produce turbine oil stocks of improved oxidation stability at dewaxing temperatures above about 630° F. has proved to be of special advantage since it permits turbine oils to be dewaxed during later portions of the dewaxing cycle when it was not previously possible to do this because of the diminished oxidation stability which resulted from the use of the higher temperatures in the later parts of the cycle. Long term oxidation stability, as measured by the Turbine Oil Oxidation Stability Test (TOST, ASTM D-943) is particularly notable, with values of at least 4000 hrs. with a standard additive package being achievable.

It has been found that the proportion of aliphatic sulfur compounds retained in the lubricant product does not decrease over the course of a dewaxing cycle and may even exhibit a minor increase at higher temperatures towards the end of the cycle. In this respect it is noted that with the NiZSM-5 catalyst, the aliphatic sulfur content of the dewaxed lube product exhibits a monotonic decrease over the dewaxing cycle and that this progressive decrease is closely matched by corresponding decreases in TOST value for turbine oil stocks.

BRIEF DESCRIPTION OF DRAWINGS

The accompanying drawings comprise seven Figures which are graphs of various aspects of catalyst performance as described in the Examples.

DETAILED DESCRIPTION

Figure 1:
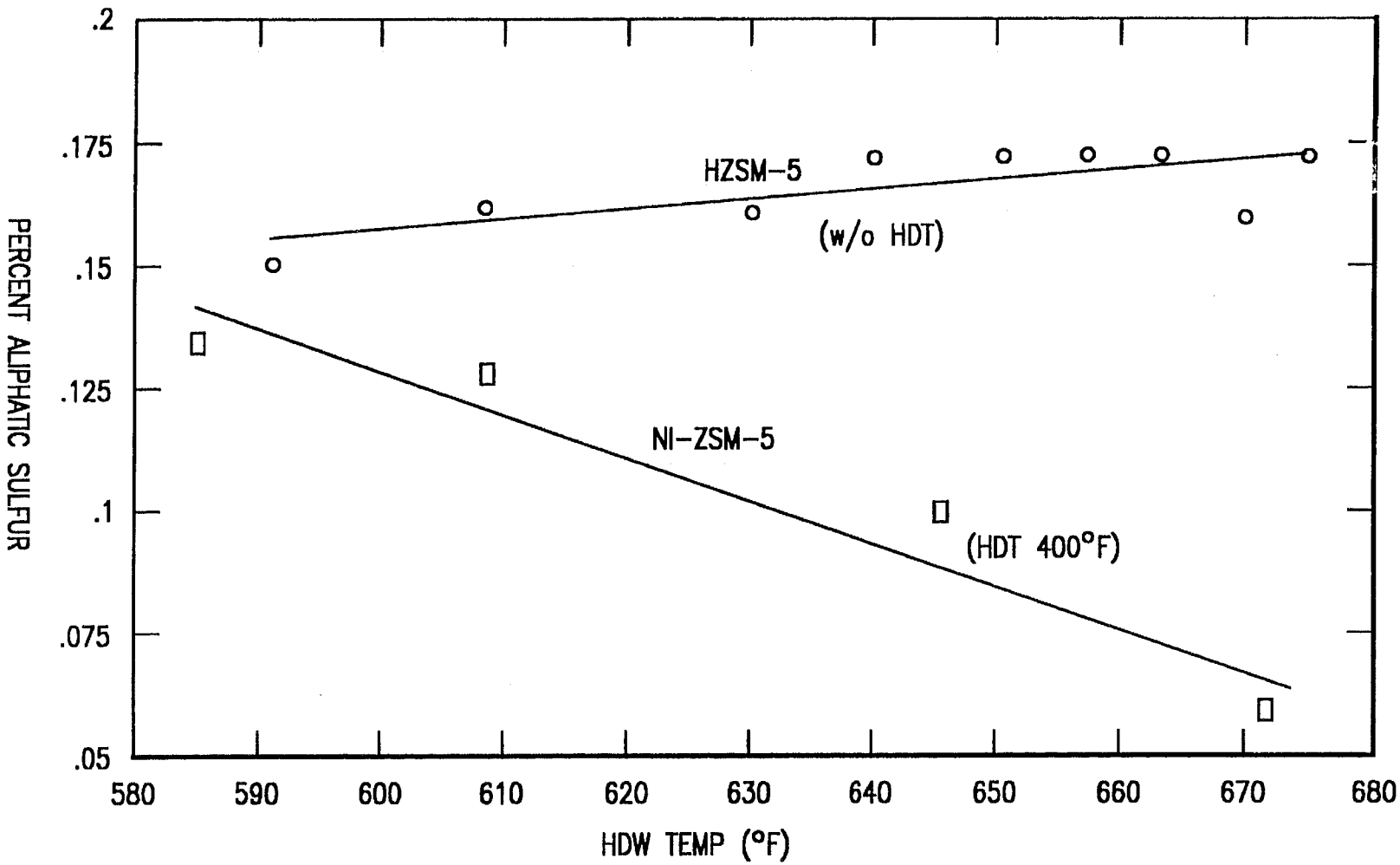

In the present process, a lube feedstock, typically a 650° F.+ (about 345° C.+) feedstock is subjected to catalytic dewaxing over an intermediate pore size dewaxing catalyst in the presence of hydrogen to produce a dewaxed lube boiling range product of low pour point (ASTM D-97 or equivalent method such as Autopour). In order to improve the stability of the dewaxed lube boiling range materials in the dewaxed effluent, a hydrotreating step is generally carried out. Products produced during the dewaxing step which boil outside the lube boiling range can be separated by fractional distillation.

FEED

The hydrocarbon feed is a lube range feed with an initial boiling point and final boiling point selected to produce a lube stock of suitable lubricating characteristics. The feed is conventionally produced by the vacuum distillation of a fraction from a crude source of suitable type. Generally, the crude will be subjected to an atmospheric distillation and the atmospheric residuum (long resid) will be subjected to vacuum distillation to produce the initial lube stocks. The vacuum distillate stocks or "neutral" stocks used to produce relatively low viscosity paraffinic products typically range from 100 SUS (20 cSt) at 40° C. for a light neutral to about 750 SUS (160 cSt) at 40° C. for a heavy neutral. The distillate fractions are usually subjected to solvent extraction to improve their V.I. and other qualities by selective removal of the aromatics using a solvent which is selective for aromatics such as furfural, phenol, or N-methyl-pyrrolidone. The vacuum resid may be used as a source of more viscous lubes after deasphalting, usually by propane deasphalting (PDA) followed by solvent extraction to remove undesirable, high viscosity, low V.I. aromatic components. The raffinate is generally referred to as Bright Stock and typically has a viscosity of 100 to 300 SUS at 100° C. (21 to 61 cSt).

Lube range feeds may also be obtained by other procedures whose general objective is to produce an oil of suitable lubricating character from other sources, including marginal quality crudes, shale oil, tar sands and/or synthetic stocks from processes such as methanol or olefin conversion or Fischer-Tropsch synthesis. The lube hydrocracking process is especially adapted to use in a refinery for producing lubricants from asphaltic or other marginal crude sources because it employs conventional refinery equipment to convert the relatively aromatic (asphaltic) crude to a relatively paraffinic lube range product by hydrocracking. Integrated all-catalytic lubricant production processes employing hydrocracking and catalytic dewaxing are described in U.S. Pat. Nos. 4,414,097, 4,283,271, 4,283,272, 4,383,913, 4,347,121, 3,684,695 and 3,755,145. Processes for converting low molecular weight hydrocarbons and other starting materials to lubestocks are described, for example, in U.S. Pat. Nos. 4,547,612, 4,547,613, 4,547,609, 4,517,399 and 4,520,221, to which reference is made for a description of these processes.

The lube stocks used for making turbine oil products are the neutral or distillate stocks produced from selected crude sources during the vacuum distillation of a crude source, preferably of a paraffinic nature such as Arab Light crude. Turbine oils are required to possess exceptional oxidative and thermal stability and generally this implies a relatively paraffinic character with substantial freedom from excessive quantities of undesirable aromatic compounds, although some aromatic content is desirable for ensuring adequate solubility of lube additives such as anti-oxidants, and anti-wear agents. The paraffinic nature of these turbine oil stocks will, however, often imply a high pour point which needs to be reduced by removing the waxier paraffins, principally the straight chain n-paraffins, the mono-methyl paraffins and the other paraffins with relatively little chain branching.

GENERAL PROCESS CONSIDERATIONS

Prior to catalytic dewaxing, the feed may be subjected to conventional processing steps such as solvent extraction to remove, if necessary, aromatics or to hydrotreating under conventional conditions to remove heteroatoms and possibly to effect some aromatics saturation or to solvent dewaxing to effect an initial removal of waxy components.

The catalytic dewaxing step operates by selectively removing the longer chain, waxy paraffins, mainly n-paraffins and slightly branched paraffins from the feed. Most processes of this type operate by selectively cracking the waxy paraffins to produce lower molecular weight products which may then be removed by distillation from the higher boiling lube stock. The catalysts which have been proposed for this purpose have usually been zeolites which have a pore size which admits the straight chain, waxy n-paraffins either alone or with only slightly branched chain paraffins but which exclude the less waxy, more highly branched molecules and cycloaliphatics. Intermediate pore size zeolites such as those having the structure of ZSM-5, ZSM-11, ZSM-12, ZSM-22, ZSM-23, ZSM-35 and ZSM-38 have been proposed for this purpose in dewaxing processes, as described in U.S. Pat. Nos. Re 28,398 (3,700,585) 3,852,189, 4,176,050, 4,181,598, 4,222,855 4,229,282, 4,287,388, 4,259,170, 4,283,271, 4,283,272, 4,357,232 and 4,428,819 to which reference is made for details of such processes. These zeolites are characterized by a constraint index of 1 to 12 as well as a structural silica:alumina ratio of at least 12:1. The significance of the Constraint Index and the method by which it is determined are described in U.S. Pat. No. 4,016,218, to which reference is made for these details. A dewaxing process employing synthetic offretite is described in U.S. Pat. No. 4,259,174. A process using a mixture of zeolites of different pore sizes is disclosed in U.S. Pat. No. 4,601,993. Reference is made to these patents for details of such processes.

The zeolite is usually composited with a binder or matrix of material such as a clay or a synthetic oxide such as alumina, silica or silica-alumina in order to improve the mechanical strength of the catalyst.

In general terms, these catalytic dewaxing processes are operated under conditions of elevated temperature, usually ranging from about 400° to 800° F. (about 205° to 425° C.), but more commonly from 500° to 700° F. (about 260° to 370° C.), depending on the dewaxing severity necessary to achieve the target pour point for the product.

As the target pour point for the product decreases the severity of the dewaxing process will be increased so as to effect an increasingly greater removal of paraffins with increasingly greater degrees of chain branching, so that lube yield will generally decrease with decreasing product pour point as successively greater amounts of the feed are converted by the selective cracking of the catalytic dewaxing to higher products boiling outside the lube boiling range. The V.I. of the product will also decrease at lower pour points as the high V.I. iso-paraffins of relatively low degree of chain branching are progressively removed.

In addition, the temperature is increased during each dewaxing cycle to compensate for decreasing catalyst activity, as described above. The dewaxing cycle will normally be terminated when a temperature of about 675° F. (about 357° C.) is reached since product stability is too low at higher temperatures. The improvement in the oxidation stability of the product is especially notable at temperatures above about 630° F. (about 330° C.) or 640° F. (about 338° C.) with advantages over the nickel-containing catalysts being obtained, as noted above, at temperatures above about 620° F. (about 325° C.).

Hydrogen is not required stoichiometrically but promotes extended catalyst life by a reduction in the rate of coke laydown on the catalyst. ("Coke" is a highly carbonaceous hydrocarbon which tends to accumulate on the catalyst during the dewaxing process.) The process is therefore carried out in the presence of hydrogen, typically at 400–800 psig (about 2860 to 5620 kPa, abs.) although higher pressures can be employed. Hydrogen circulation rate is typically 1000 to 4000 SCF/bbl, usually 2000 to 3000 SCF/bbl of liquid feed (about 180 to 710, usually about 355 to 535 n.1.1.$^{-1}$). Space velocity will vary according to the chargestock and the severity needed to achieve the target pour point but is typically in the range of 0.25 to 5 LHSV (hr$^{-1}$), usually 0.5 to 2 LHSV.

In order to improve the quality of the dewaxed lube products, a hydrotreating step follows the catalytic dewaxing in order to saturate lube range olefins as well as to remove heteroatoms, color bodies and, if the hydrotreating pressure is high enough, to effect saturation of residual aromatics. The post-dewaxing hydrotreating is usually carried out in cascade with the dewaxing step so that the relatively low hydrogen pressure of the dewaxing step will prevail during the hydrotreating and this will generally preclude a significant degree of aromatics saturation. Generally, the hydrotreating will be carried out at temperatures from about 400° to 600° F. (about 205° to 315° C.), usually with higher temperatures for residual fractions (bright stock), (for example, about 500° to 575° F. (about 260° to 300° C.) for bright stock and, for example, about 425° to 500° F. (about 220° to 260° C.) for the neutral stocks. System pressures will correspond to overall pressures typically from 400 to 1000 psig (2860 to 7000) kPa, abs.) although lower and higher values may be employed e.g. 2000 or 3000 psig (about 13890 kPa or 20785 abs.). Space velocity in the hydrotreater is typically from 0.1 to 5 LHSV (hr$^{-1}$), and in most cases from 0.5 to 2 hr$^{-1}$.

Processes employing sequential lube catalytic dewaxing-hydrotreating are described in U.S. Pat. Nos. 4,181,598, 4,137,148 and 3,894,938. A process employing a reactor with alternating dewaxing-hydrotreating beds in disclosed in U.S. Pat. No. 4,597,854. Reference is made to these patents for details of such processes.

DEWAXING CATALYST

As described in general terms above, the dewaxing catalyst preferably comprises an intermediate pore size zeolite such as those having the structure of ZSM-5, ZSM-11, ZSM-23 or ZSM-35, which has a structural silica:alumina ratio of at least 12:1 as well as a Constraint Index of 1 to 12, preferably 2 to 7. As described in U.S. Pat. Nos. 3,980,550 and 4,137,148, a metal hydrogenation component such as nickel was considered desirable for reducing catalyst aging. The use of these metals, especially nickel, has, however, been found to have an adverse effect on the oxidation stability of the lube products and is not essential for extended cycle life or amenability to reaction with hydrogen. This is unexpected because the conventional view has been that although the metal component has not participated in the dewaxing mechanism as such (because dewaxing is essentially a shape-selective cracking reaction which does not require the mediation of a hydrogenation-dehydrogenation function) it did contribute to the entire dewaxing process by promoting the removal of the coke by a process of hydrogen transfer to form more volatile hydrocarbons which were removed at the temperatures prevailing at the time. For the same reasons, the metal component improved the hydrogen reactivation of the catalyst between successive dewaxing cycles, as described in U.S. Pat. Nos. 3,956,102, 4,247,388 and 4,508,836, as mentioned above.

The present dewaxing process is based upon the unexpected finding that satisfactory and even improved catalyst aging and reactivation characteristics, as well as improved product properties, may be obtained by using a catalyst which contains no metal hydrogenation component. Although there is a limit to which the temperature may be raised during the course of the dewaxing cycle since selectivity and product stability will still decrease with temperature even with the present catalysts, the use of the present catalysts enables the dewaxing cycle to be extended and runs with premium quality lubes, especially turbine oils, can be extended into a greater portion of each dewaxing cycle, increasing the flexibility of operation. At the same time, catalyst aging is not unduly compromised by the absence of the metal function even at the higher temperatures above about 620° F. (about 325° C.) encountered towards the end of each dewaxing cycle.

In fact, catalyst aging characteristics may be materially improved by the use of the present metal-free catalysts: a trend towards line-out behavior is noted, with aging rates decreasing to values below about 1° F./day (about 0.5° C./day) in the latter portions of the dewaxing cycle, for example, at temperatures above about 650° F. (about 345° C.). Cumulative aging rates below about 5° F./day (about 2.8° C./day), usually below about 4° F./day (about 2° C./day) may be obtained over the course of the cycle.

The improved amenability of the catalyst to reactivation by hydrogen stripping is also unexpected since the metal function was thought to be essential to satisfactory removal of the coke during this step. Contrary to this expectation, it has been found not only that the reactivated catalyst gives adequate performance over the second and subsequent cycles but that cycle lengths may even be extended with comparable catalyst activities at the beginning of each cycle so that equivalent start-of-cycle (SOC) temperatures may be employed.

It is believed that the improvements in aging rate and susceptibility to hydrogen reactivation which are associated with the use of the metal-free dewaxing catalysts may be attributable to the character of the coke formed during the dewaxing. It is possible that at the higher temperatures prevailing at the end of the dewaxing cycle, the nickel or other metal component promotes dehydrogenation of the coke and converts to a harder or more highly carbonaceous form; in this form not only is the catalyst aging increased but the hard coke so formed is less amendable to hydrogenative stripping between cycles. Thus, the absence of the metal component may be directly associated with the end-of-cycle aging improvements and the improved reactivation characteristics of the catalyst.

Similarly, the characteristic coke and other contaminants formed on the metal-free catalyst may be more readily desorbable by the lighter feeds, such as light neutral raffinates, resulting in improved hydrogen reactivation effects which are absent when metal catalyst, e.g., nickel catalyst, is similarly treated.

The hydrogen reactivation of the present invention can be carried out at 800° to 1100° F., preferably at 900° to 1000° F., for 4 to 30 hours, preferably 16 to 20 hours, at 100 to 3000 psig $H_2$, preferably at 350 to 500 psig $H_2$.

The hydrogen or decationized or "acid" form of the zeolite is readily formed in the conventional way by cation exchange with an ammonium salt followed by calcination to decompose the ammonium cations, typically at temperatures above about 800° F. (about 425° C.), usually about 1000° F. (about 540° C.). Dewaxing catalysts containing the acid form zeolite are conveniently produced by compositing the zeolite with the binder and forming the catalyst particles followed by ammonium exchange and calcination. If the zeolite has been produced using an organic directing agent, calcination prior to the cation exchange step is necessary to remove the organic from the pore structure of the zeolite; this calcination may be carried out either in the zeolite itself or the matrixed zeolite.

HYDROTREATING

The hydrotreating step following the dewaxing offers further opportunity to improve product quality without significantly affecting its pour point.

The metal function on the hydrotreating catalyst is effective in varying the degree of desulfurization in the same way as the metal function on the dewaxing catalyst. Thus, a hydrotreating catalyst with a strong desulfurization/hydrogenation function such as nickel-molybdenum or cobalt-molybdenum will remove more of the sulfur than a weaker desulfurization function such as molybdenum. Thus, because the retention of certain desired sulfur compounds is related to superior oxidative stability, the preferred hydrotreating catalysts will comprise a relatively weak hydrodesulfurization function on a porous support. Because the desired hydrogenation reactions require no acidic functionality and because no conversion to lower boiling products is desired in this step, the support of the hydrotreating catalyst is essentially non-acidic in character. Typical support materials include amorphous or crystalline oxide materials such as alumina, silica, and silica-alumina of non-acidic character. The metal content of the catalyst is typically up to about 20 weight percent for base metals with lower proportions being appropriate for the more active noble metals such as palladium. Hydrotreating catalysts of this type are readily available from catalyst suppliers. These catalysts are generally presulfided using $H_2S$ or other suitable sulfur containing compounds.

The degree of desulfurization activity of the catalyst may be found by experimental means, using a feed of known composition under fixed hydrotreating conditions.

Control of the reaction parameters of the hydrotreating step also offers a useful way of varying the product properties. As hydrotreating temperature increases the degree of desulfurization increases; although hydrogenation is an exothermic reaction favored by lower temperatures, desulfurization usually requires some ring-opening of heterocyclic compounds to occur and these reactions being endothermic, are favored by higher temperatures. If, therefore, the temperature during the hydrotreating step can be maintained at a value below the threshold at which excessive desulfurization takes place, products of improved oxidation stability are obtained. Using a metal such as molybdenum on the hydrotreating catalyst temperatures of about 400°–700° F. (about 205°–370° C.), preferably about 500°–650° F. (about 260°–315° C.) are recommended for good oxidative stability. Space velocity in the hydrotreater also offers a potential for desulfurization control with the higher velocities corresponding to lower severities being appropriate for reducing the degree of desulfurization. The hydrotreated product preferably has an organic sulfur content of at least 0.10 wt. percent or higher e.g. at least 0.20 wt. percent, e.g. 0.15–0.20 wt. percent.

Variation of the hydrogen pressure during the hydrotreating step also enables the desulfurization to be controlled with lower pressures generally leading to less desulfurization as well as a lower tendency to saturate aromatics, and eliminate peroxide compounds and nitrogen, all of which are desirable. A balance may therefore need to be achieved between a reduced degree of desulfurization and a loss in the other desirable effects of the hydrotreating. Generally, pressures of 200 to 1000 psig (about 1480 to 7000 kPa abs) are satisfactory with pressures of 400 to 800 psig (about 2860 to 5620 kPa abs) giving good results with appropriate selection of metal function and other reaction conditions made empirically by determination of the desulfurization taking place with a given feed.

SEQUENCING

The preferred manner of sequencing different lube feeds through the dewaxer is first to process heavy feeds such as Heavy Neutral and Bright Stock, followed by lighter feeds such as Light Neutral in order to avoid contacting the light stocks with the catalyst in its most active conditions. In practice we prefer a Heavy Neutral/Bright Stock/Light Neutral sequence in the course of a dewaxing cycle.

The lighter feeds may be obtained from distillation of crudes, and solvent extraction and/or hydrocracking of light distillate cuts, and can be exemplified by light neutrals, transformer oils, refrigerator oils, and specialty oils such as spray oils. These feeds can be characterized by 50% boiling point of less than about 850° F., and kinematic viscosity at 100° C. of less than about 9 centistokes.

The heavy feeds may be obtained from distillation crudes, and solvent extraction and/or hydrocracking of heavy distillate cuts and residua, and can be exemplified by heavy neutrals, and residual propane deasphalted (PD) raffinates. These feeds can be characterized by 50% boiling point of greater than about 850° F., and kinematic viscosity at 100° C. of greater than about 9 centistokes.

Preferably, both the relatively light and the relatively heavy feeds are processed either through the conventional furfural extraction or hydrocracking process steps prior to their introduction to the dewaxing unit, in order to reduce undesired aromatic and heterocyclic components from the dewaxer feed.

Preferably, the dewaxing with lighter feed is carried out at least two days, preferably for at least 30 days, prior to hydrogen reactivation.

PRODUCTS

The lube products obtained with the present process have a higher retained sulfur content than corresonding lubes dewaxed over a metal-containing dewaxing catalyst e.g. NiZSM-5. The retained aliphatic sulfur content, in particular, is higher and it is believed that the noted improvements in product stability may be attributable in part to the retention of these compounds. In general terms, the sulfur content of the products will increase with product initial boiling point an viscosity and is typically as follows:

TABLE 1

Typical Minimum Lube Sulfur Content, wt. pct.

| Lube | $^{S}$Total | $^{S}$Aliph |
|---|---|---|
| Light Neutral (100–200 SUS at 40° C.) | 0.2–0.6 | 0.15–0.25 |
| Heavy Neutral (600–800 SUS at 40° C.) | 0.9–1.25 | 0.3–0.4 |
| Bright Stock (100–300 SUS at 100° C.) | 1.00–1.5 | 0.35–0.5 |

A notable feature of the present process is that the sulfur content of the dewaxed lube product remains essentially constant over the duration of the dewaxing cycle as the temperature of the dewaxing step is increased to compensate for the progressive decrease in the dewaxing activity of the catalyst. This behavior is in marked contrast to the behavior observed with the metal-functionalized dewaxing catalysts such as NiZSM-5 where the aliphatic sulfur content decreases in a marked fashion as the temperature increases in the cycle. In fact, increases in aliphatic sulfur may be observed.

CATALYST REACTIVATION

As noted above, the dewaxing catalysts are preferably reactivated by treatment with hot hydrogen to restore activity by removing soft coke and coke precursors in the form of more volatile compounds which are desorbed from the catalyst under the conditions employed. Suitable reactivation procedures are disclosed in U.S. Pat. Nos. 3,956,102, 4,247,388 and 4,508,836. A notable and perhaps significant feature of the present metal-free catalysts is that the total amount of ammonia released during the hydrogen reactivation is significantly less than that from metal-containing dewaxing catalysts such as NiZSM-5. This may indicate that fewer heterocyclic compounds are sorbed as coke precursors by the metal-free catalysts, consistent with the observation that a greater degree of sulfur retention also occurs.

EXAMPLE 1

A light neutral (150 SUS at 40° C.) waxy raffinate was catalytically dewaxed over an HZSM-5 alumina dewaxing catalyst (65 wt. pct. HZSM-5, 35 wt. pct. alumina) at temperatures between 590° F. and 676° F. (310° C. and 350° C.), 2 $hr^{-1}$ LHSV, 400 psig (2860 kPa abs.) 2500 SCF/bbl $H_2$ circulation rate (445 $n.l.l.^{-1}$) to provide a turbine oil base stock. A number of the dewaxed products were then hydrotreated using a molybdenum/alumina hydrotreating catalyst at the same hydrogen pressure and circulation rate. The products were topped to produce a 650° F.+ (345° C.+) lube product to which a standard mixed double inhibited antioxidant/antirust inhibitor package containing a hindered phenol antioxidant was added. The oxidation stability was then determined by the Rotating Bomb Oxidation Test, ASTM D-2272 and the Turbine Oil Oxidation Stability Test D-943. The results are shown in Table 2 below.

TABLE 2

Turbine Oil Dewaxing over HZSM-5

| Run No. | HDW/ HDF °F. | Pour Pt, °F. (°C.) | RBOT, Mins. | TOST, hrs. | Sulfur wt pct | Aliphatic Sulfur, wt pct |
|---|---|---|---|---|---|---|
| 1-1 | 590/— | 35 (2) | 460 | 5650 | 0.36 | 0.15 |
| 1-2 | 608/— | 25 (−4) | 440 | 6050 | 0.36 | 0.16 |
| 1-3 | 630/— | 15 (−9) | 390 | 5894 | 0.38 | 0.16 |
| 1-4 | 640/— | 10 (−12) | 385 | 5201 | 0.37 | 0.17 |
| 1-5 | 651/— | 5 (−15) | 435 | 5762 | 0.37 | 0.17 |
| 1-6 | 658/— | 5 (−15) | 385 | 5896 | 0.37 | 0.17 |
| 1-7 | 664/— | 10 (−12) | 400 | 5973 | 0.36 | 0.17 |
| 1-8 | 671/— | 5 (−15) | 355 | 5171 | .0.39 | 0.16 |
| 1-9 | 676/— | 5 (−15) | 395 | 5318 | 0.37 | 0.17 |
| 1-10 | 660/450 | 20 (−7) | — | 4544 | 0.38 | — |
| 1-11 | 660/500 | 20 (−7) | — | 5216 | 0.39 | — |
| 1-12 | 660/550 | 20 (−7) | — | 5794 | 0.35 | — |
| 1-13 | 660/600 | 20 (−7) | — | 6050 | 0.29 | — |
| 1-14 | 660/600 | 20 (−7) | — | 4544 | 0.22 | — |

A comparison run with solvent dewaxing (MEK/toluene) to 5° F. (−15° C.) pour point yielded a product with an RBOT of 495 minutes, TOST of 6428 hours, and sulfur content of 0.35 (total) and 0.17 (aliphatic) weight percent, respectively.

These results show that the absence of the metal function on the dewaxing catalyst results in no significant increase in desulfurization as the catalyst ages and the temperature is increased. The products all possessed excellent oxidation stability and were suitable for use as turbine oils.

EXAMPLE 2

The same light neutral oil was subjected to dewaxing over a NiZSM-5 dewaxing catalyst (65 wt. pct. ZSM-5, 35 wt. pct. alumina, 1 wt. pct. Ni on catalyst) under similar conditions at 1 LHSV, 400 psig $H_2$ (2860 kPa abs.), 2500 SCF/Bbl $H_2$:oil (445 $n.l.l.^{-1}$), followed by hydrotreating of the dewaxed product as described above. The topped (650° F., 345° C.+) product was then tested for RBOT and TOST. The results are given in Table 3 below.

TABLE 3

Properties of Light Neutral Turbine Oil Dewaxed Over Ni ZSM-5

| Run | Hydrodewaxing Temperature, °F. (°C.) | Hydrofinishing Temperature, °F. (°C.) | Pour Point °F. (°C.) | Oxidation Stability RBOT - minutes | Sulfur, wt pct | Aliphatic Sulfur, | TOST hrs |
|---|---|---|---|---|---|---|---|
| 1-11 | 572 (300) | 500 (260) | 30 (−1) | 465 | 0.18 | 0.10 | 5378 |
| 1-12 | 575 (302) | 500 (260) | 15 (−9) | 485 | 0.18 | 0.10 | 4887 |
| 1-13 | 585 (307) | 500 (260) | 35 (2) | 500 | 0.18 | 0.10 | 5062 |
| 1-14 | 639 (337) | 500 (260) | 35 (2) | 380 | 0.17 | 0.09 | 3866 |
| 1-15 | 664 (351) | 500 (260) | 15 (−9) | 295 | 0.12 | 0.04 | 2225 |
| 1-16 | 671 (355) | 500 (260) | 20 (−7) | 295 | 0.115 | 0.04 | — |
| 1-17 | 676 (358) | 500 (260) | 15 (−9) | 260 | 0.17 | 0.05 | 1352 |
| 1-18 | 584 (307) | 400 (204) | 5 (−15) | 485 | 0.315 | 0.14 | 4635 |
| 1-19 | 594 (312) | 400 (204) | 15 (−9) | 470 | 0.305 | 0.14 | — |
| 1-20 | 608 (320) | 400 (204) | 15 (−9) | 480 | 0.295 | 0.13 | 4337 |
| 1-21 | 634 (334) | 400 (204) | 5 (−15) | 440 | 0.32 | 0.12 | — |
| 1-22 | 645 (340) | 400 (204) | 5 (−15) | 410 | 0.30 | 0.10 | 2526 |
| 1-23 | 652 (344) | 400 (204) | 20 (−7) | 360 | 0.28 | 0.08 | — |
| 1-24 | 672 (355) | 400 (204) | 15 (−9) | 295 | 0.23 | 0.06 | 1517 |

Comparison of Tables 2 and 3 above shows that the catalyst without a metal function is capable of producing turbine oil with a minimum TOST of about 4000 hours at dewaxing temperatures as high as about 676° F. (358° C.) whereas the nickel-containing dewaxing catalyst is frequently ineffective at temperatures above about 630° F. (about 330° C.).

EXAMPLE 3

The waxy raffinate of Example 1 was subjected to catalytic dewaxing over an HZSM-5 dewaxing catalyst (65 wt. pct. HZSM-5, 35 wt. pct. alumina) at 660° F. (349° C.), 400 psig $H_2$ (2860 kPa abs.) at 2 LHSV. The dewaxed product was then hydrotreated at temperatures from 450° to 600° F. (232°–315° C.) at 1 or 2 LHSV over a molybdenum/alumina hydrotreating catalyst. The results are given in Table 4 below. TOST results were obtained with the same standard additive package described above.

TABLE 4

HZSM-5 Lube Dewaxing

| Run | Hydrodewaxing Temperature, °F. (°C.) | Hydrofinishing Temperature, °F. (°C.) | Pour Point °F. (°C.) | RBOT, Minutes | Sulfur, wt pct | TOST Hrs | HDF LHSV $hr^{-1}$ |
|---|---|---|---|---|---|---|---|
| 3-1 | 660 | 450 | 20 | 525 | 0.38 | 6613 | 2 |
| 3-2 | 660 | 500 | 20 | 525 | 0.39 | 5216 | 2 |
| 3-3 | 660 | 550 | 20 | 540 | 0.35 | 5794 | 2 |
| 3-4 | 660 | 600 | 20 | 520 | 0.29 | 6050 | 2 |
| 3-5 | 660 | 600 | 20 | 465 | 0.22 | 4544 | 1 |

EXAMPLE 4

The increased sulfur retention resulting from the use of the decationized zeolites was demonstrated by dewaxing a light neutral raffinate turbine oil stock over NiZSM-5 (1 wt. pct. Ni) and HZSM-5 dewaxing catalysts (65% ZSM-5, 35% $Al_2O_3$), at 650° F. (343° C.), 1 $hr^{-1}$ LHSV and 400 psig (2860 kPa abs).

The properties of the products are given in Table 5 below, together with a comparison with a solvent dewaxed oil (SDWO).

TABLE 5

IN Sulfur Retention

| HDT Temp, °F. | ASTM Color | $Br_2$ No. | Pour Pt. °F. | Pour Pt. °F. | $N_{total}$ ppm | $N_{basic}$ ppm | $S_{total}$ % | $S_{aliph}$ % |
|---|---|---|---|---|---|---|---|---|
| Ni-ZSM-5 HDW Products | | | | | | | | |
| None* | L1.5 | 2.35 | 15 | 30 | 21 | 21 | 0.60 | 0.24 |
| 350 | L1.0 | 3.14 | 15 | 26 | 17 | 22 | 0.58 | 0.23 |
| 400 | L0.5 | 3.08 | 20 | 23 | 18 | 21 | 0.58 | 0.22 |
| 450 | L0.5 | 2.78 | 10 | 21 | 17 | 22 | 0.58 | 0.23 |
| 500 | 0.5 | 2.28 | 5 | 18 | 19 | 21 | 0.58 | 0.22 |
| SDWO | — | — | — | — | 19 | 19 | 0.62 | 0.25 |
| HZSM-5 HDW Products | | | | | | | | |
| None* | L1.5 | 1.62 | 20 | 32 | 21 | 23 | 0.64 | 0.28 |
| 350 | L1.0 | 2.21 | 15 | 26 | 16 | 22 | 0.62 | 0.28 |
| 400 | L1.0 | 2.26 | 15 | 23 | 19 | 22 | 0.62 | 0.27 |
| 450 | L0.5 | 1.84 | 10 | 20 | 19 | 22 | 0.62 | 0.28 |
| 500 | L0.5 | 1.62 | 10 | 18 | 18 | 22 | 0.62 | 0.27 |

*Inter-reactor sample (HDW reactor only)

These results show that the HZSM-5 dewaxing catalyst produces a product with a greater retained sulfur content, especially of aliphatic sulfur, and a smaller bromine number, as compared to the products from NiZSM-5 dewaxing.

EXAMPLE 5

The effect of dewaxing temperature on the aliphatic sulfur content of the product was demonstrated by dewaxing light neutral raffinate turbine oil stocks (feed 0.26 wt. pct. total sulfur, 0.14 wt. pct. aliphatic sulfur) over NiZSM-5 (1% Ni) and HZSM-5 dewaxing catalysts (65% ZSM-5, 35% $Al_2O_3$) at 400 psig $H_2$ (2860 kPa), 1 LHSV over the course of dewaxing cycles with temperatures increasing from about 580° to 675° F. (about 305° to 357° C.). The products treated over NiZSM-5 (unsteamed) were then hydrotreated over a $Mo/Al_2O_3$ hydrotreating catalyst at 400° F., 400 psig $H_2$ (205° C., 2860 kPa). The results, assembled from historical data, are shown in FIG. 1 and demonstrate a slight increase in product sulfur content as the dewaxing temperature is increased over the course of the dewaxing cycle from 585° F. (307° C.) to 675° F. (357° C.) for the HZSM-5 catalyst whereas the NiZSM-5 catalyst resulted in a progressive decrease in product sulfur, directly attributable.

Figure 2:
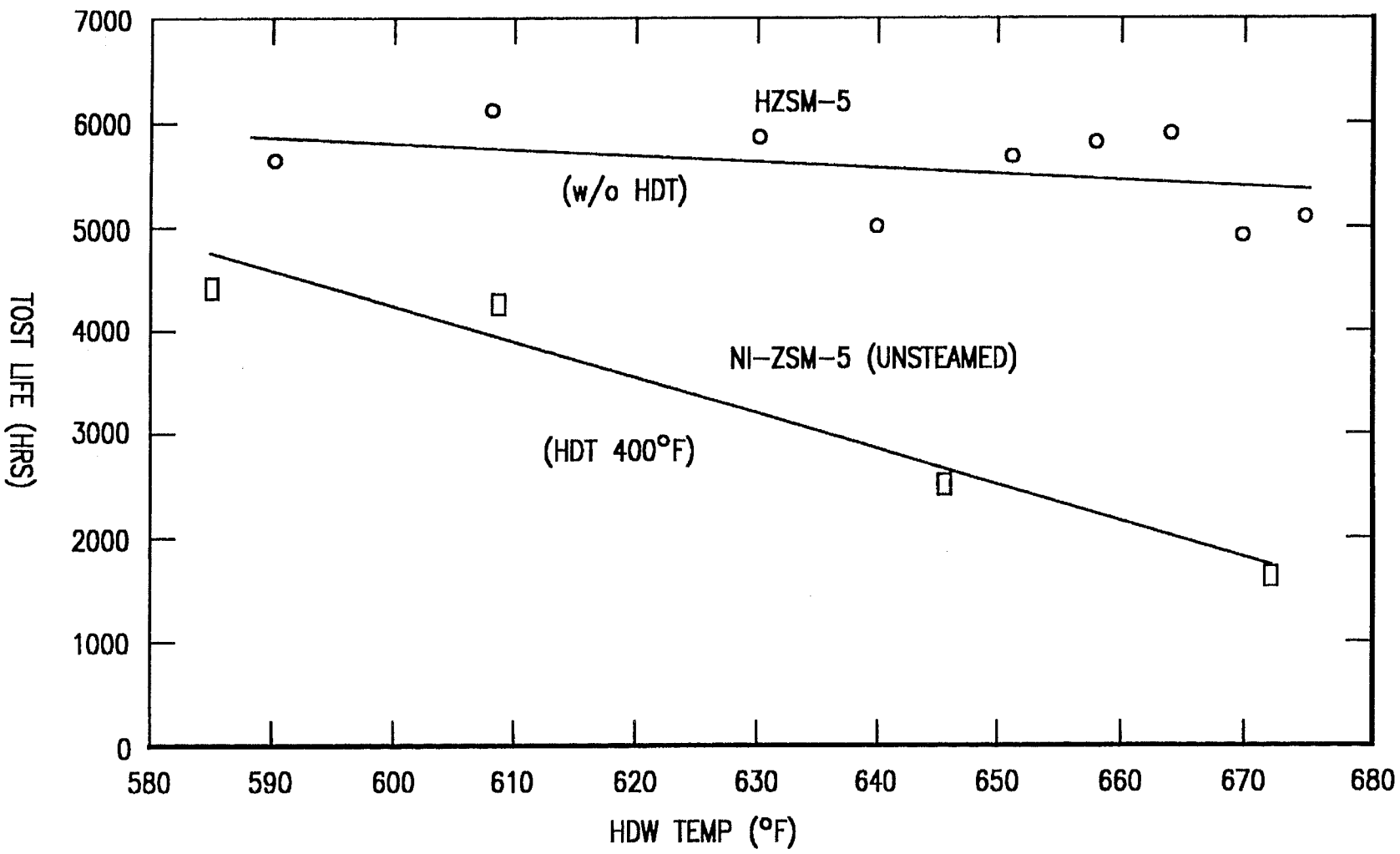
Figure 3:
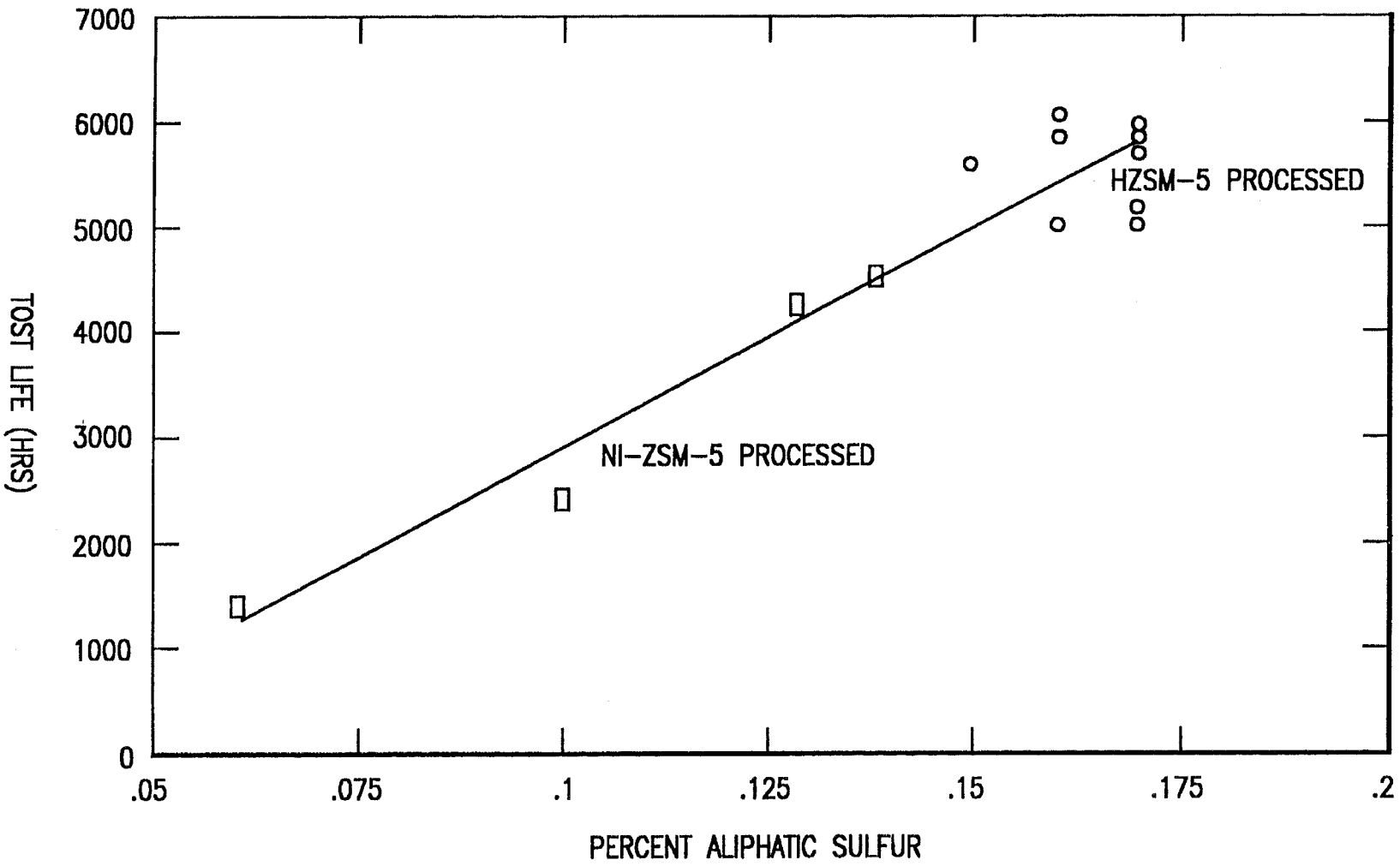

The influence of dewaxing temperature on TOST values parallels that of aliphatic sulfur content, as shown by FIG. 2 from historical data, indicating a correlation between the improved product stability and the enhanced sulfur retention. The TOST results are plotted directly against aliphatic sulfur content in FIG. 3, with a clear indication that the highest TOST values are to be attained by the use of the decationized zeolite with retained aliphatic sulfur levels of 0.15–0.175 wt. percent. The nickel ZSM-5 catalyst, by contrast, gives lower TOST values and retained aliphatic sulfur levels of under 0.15 wt. percent typically in the range 0.05 to 0.15 wt. percent.

EXAMPLE 6

Figure 4:
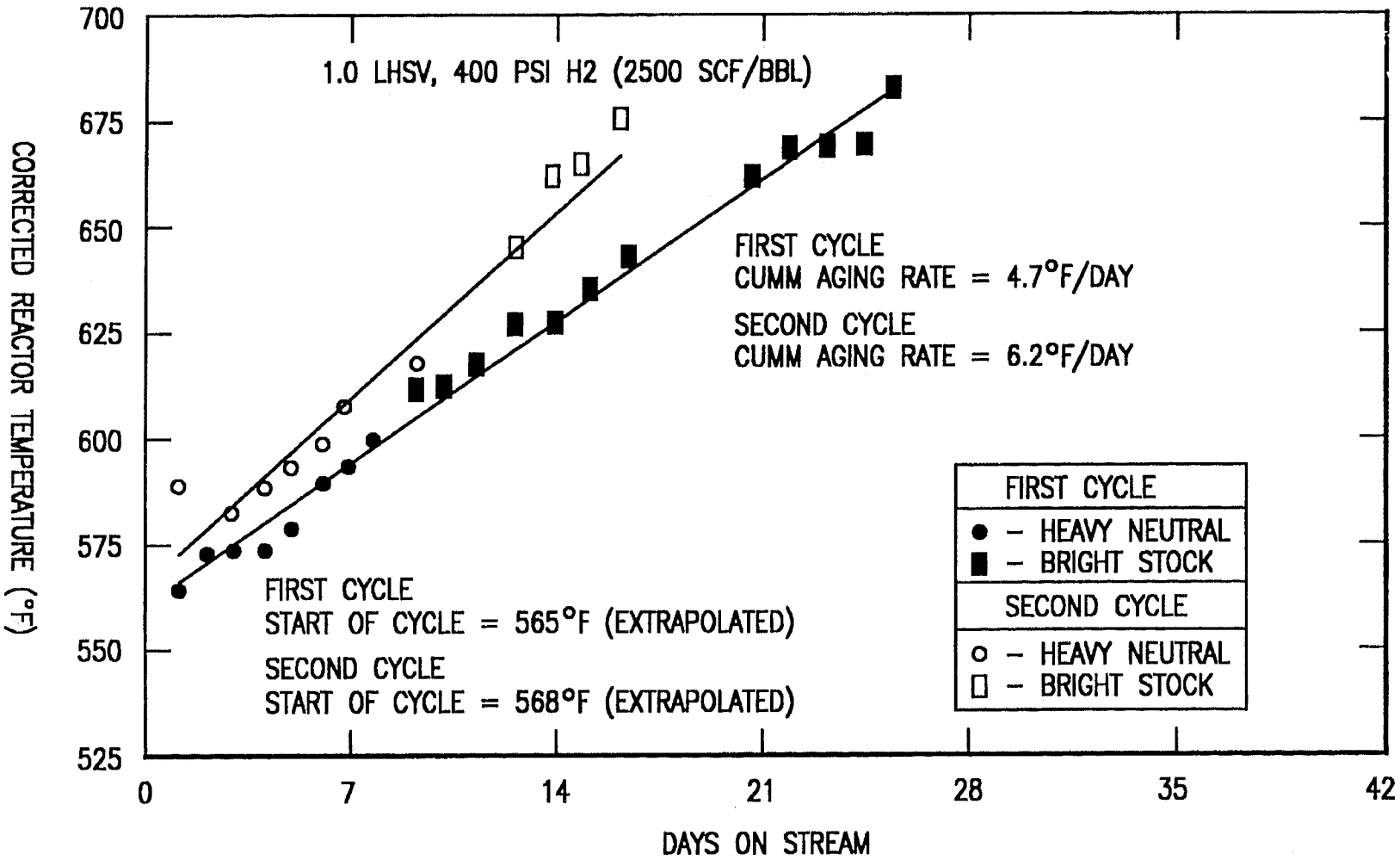
Figure 5:
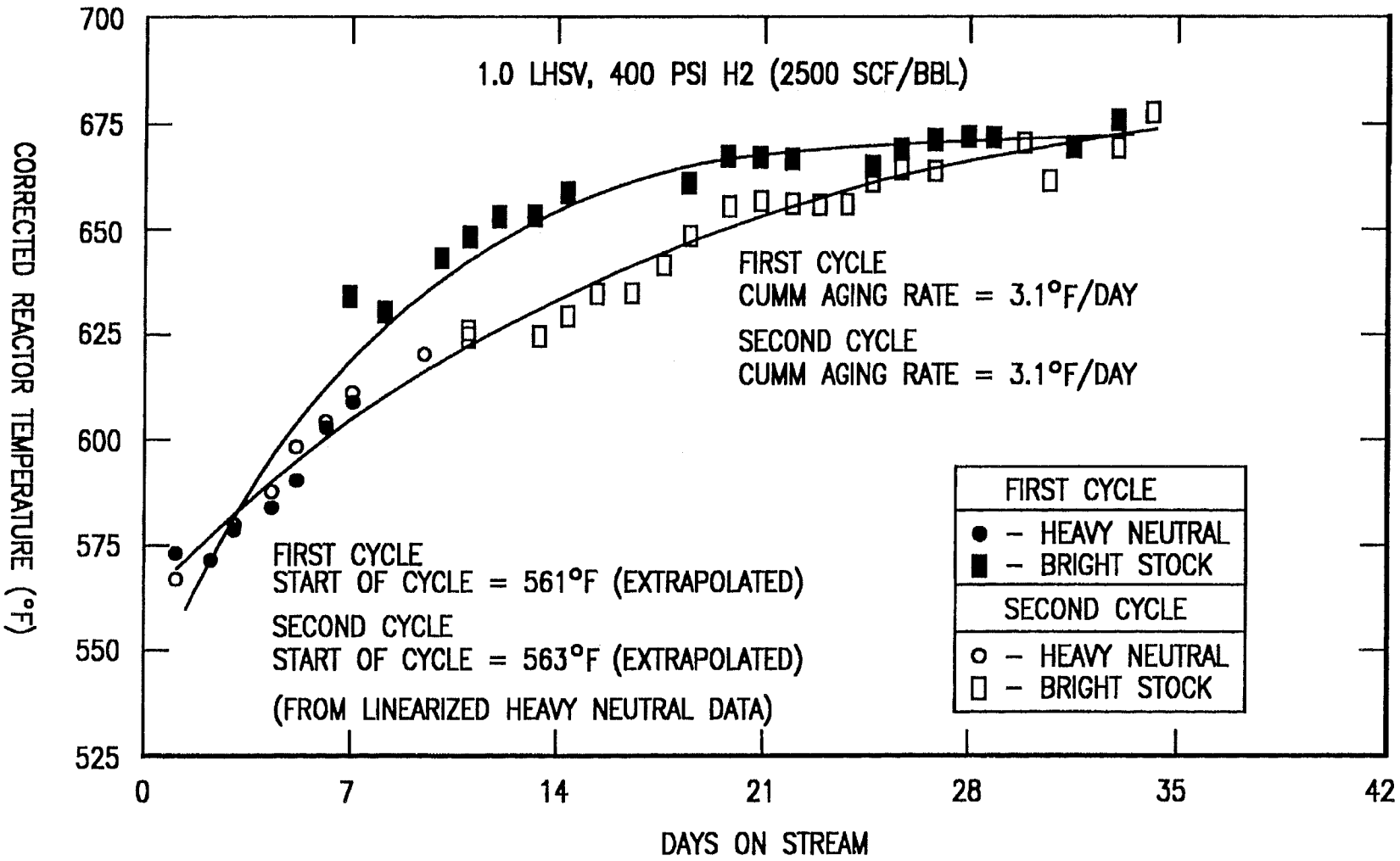

The effect of the metal component was shown by carrying out dewaxing of Arab Light heavy neutral and bright stock feeds over the NiZSM-5 and HZSM-5 catalysts at 1 LHSV, 400 psig (2800 kPa), with subsequent hydrofinishing over $Mo/Al_2O_3$ at 450° F. (232° C.) to a product pour point of 10°–15° F. The temperature profiles during the cycles are shown in FIGS. 4 (NiZSM-5) and 5, respectively, both for first cycle and second cycle operation with an intervening hydrogen reactivation (16 hrs., 980° F. 400 psig $H_2$). As shown in FIG. 4, the NiZSM-5 ages uniformly throughout the cycle whereas the HZSM-5 (FIG. 5) tends to line out in the first cycle at least with an aging rate of but 0.9° F./day at temperatures above 660° F. (350° C.).

The NiZSM-5 achieved a first cycle duration of 25 days to the maximum temperature of 670° F. (355° C.) and aged at a uniform rate of about 5° F./day. After reactivation, a 16 day cycle was achieved, with a cumulative aging rate of about 6° F./day.

The HZSM-5 showed an unexpected transient aging during the first cycle with an initial aging rate of about 7° F./day, decreasing to about 1° F./day later in the cycle (above about 650° F.). This resulted in a 33 day cycle, which is about 30% longer than obtained with the NiZSM-5. After reactivation, a second cycle of equal length was obtained as the aging rate was again about 3° F./day; although about 20° F. SOC activity was lost (as compared to about 5° F. for NiZSM-5), this was offset by a slower transient aging rate early in the cycle.

In a third dewaxing following hydrogen reactivation under the same conditions as before, the same line-out behavior as in the second cycle was observed, with an aging rate of less than about 1° F./day in the later part of the cycle, at temperatures above about 650° F. The third cycle was almost identical in length to the second cycle and SOC temperature was 550° F. (extrapolated).

EXAMPLE 7

Figure 6:
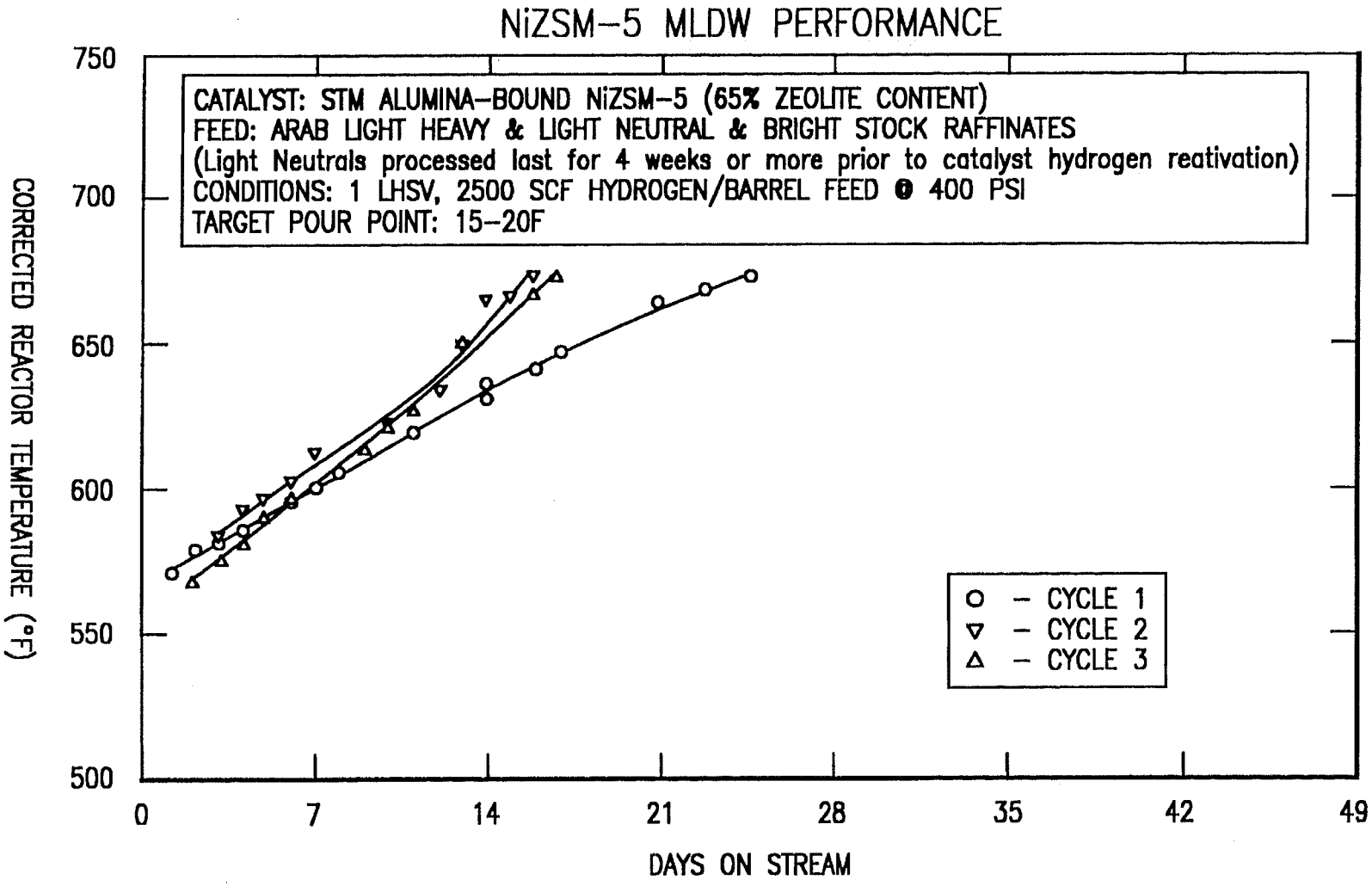

A steamed dewaxing catalyst containing 1.0 wt % Ni, 65 parts ZSM-5 per 35 parts alumina was used to dewax Arab Light heavy raffinates in the temperature range of 560° F. to end of cycle temperature of 675° F., followed by four weeks of light neutral dewaxing. Following light neutral dewaxing, the feed was turned off and the catalyst was hydrogen reactivated by heating the catalyst at 1000° F. for 24 hours. The reactivated catalyst was cooled and a subsequent cycle started. The hydrodewaxing was carried out at 400 psig, 1 LHSV, 2500 scfb $H_2$ and the results are shown in FIG. 6, where the temperature required for 20° F. pour product is plotted against days on stream. The processing days for cycles 1,2,& 3 for heavy raffinates are 25, 17, and 16 days, respectively.

EXAMPLE 8

Figure 7:
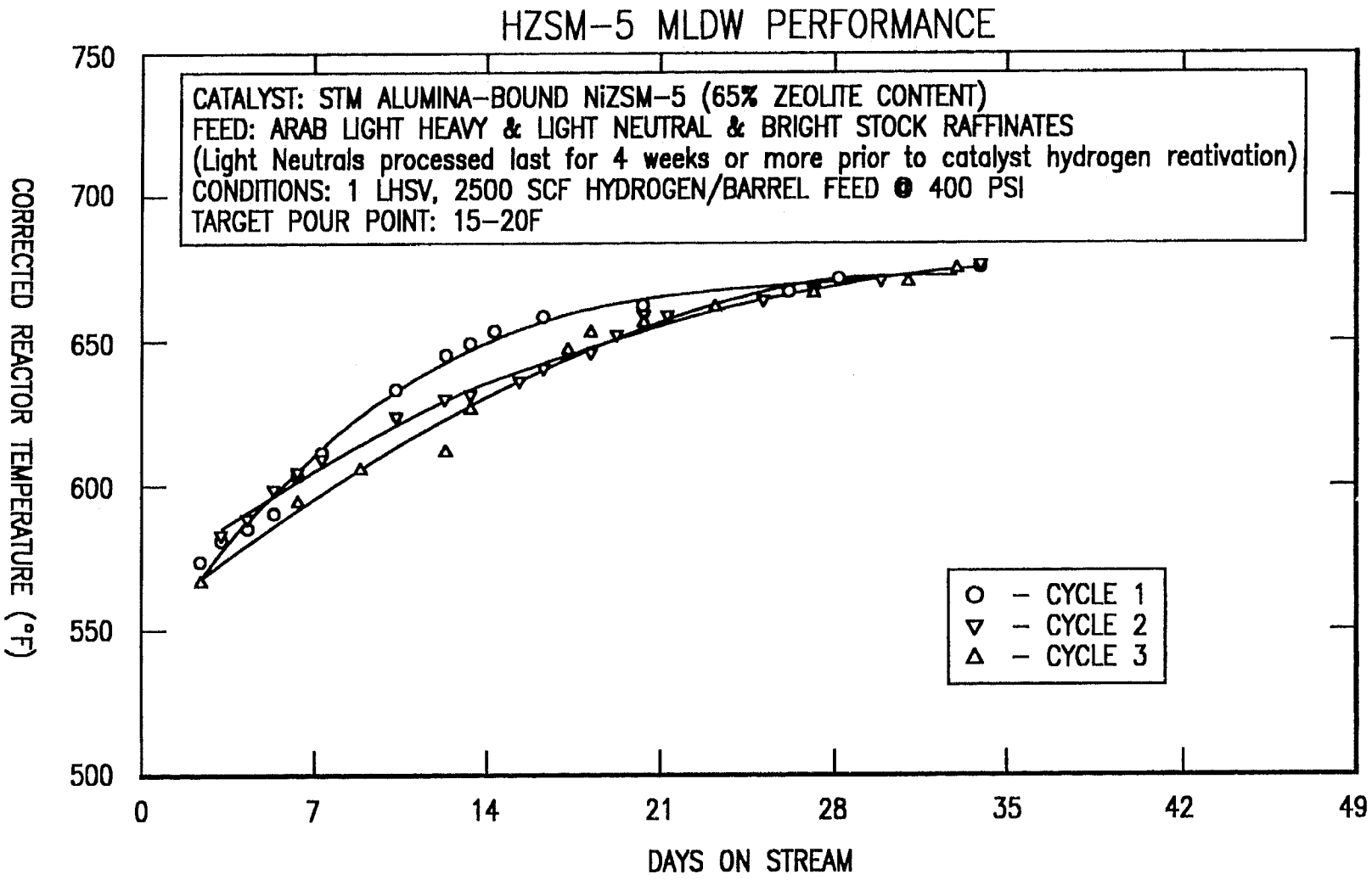

A steamed nickel-free dewaxing catalyst containing 65 parts ZSM-5 and 35 parts aluumina was evaluated as described in Example 6. Light neutral raffinate was dewaxed for four weeks prior to hydrogen reactivation. As shown in FIG. 7 with heavy raffinate dewaxing, the processing days for cycles 1,2, and 3 are 34, 33, and 33 days, respectively. The data indicate the nickel-free catalyst maintained cycle-to-cycle performance.

EXAMPLE 9

The catalyst of Example 8 was evaluated for dewaxing Arab Light bright stock followed by one day washing with a light vacuum gas oil prior to hydrogen reactivation. The processing days for cycles 1, 2 and 3 are 33, 25, and 21 days, respectively.

EXAMPLE 10

The catalyst of Example 8 was evaluated for dewaxing Arab Light bright stock as in Example 9. At the end of the first cycle (675° F.), Arab Light light neutral raffinate was dewaxed for five days followed by hydrogen reactivation. The third cycle length is 26 days. The data in Examples 9 and 10 indicate that more than five days of light raffinate processing are needed for effective hydrogen reactivation following the first cycle. Furthermore, third cycle data indicate that light neutral is a more effective cleaning agent than vacuum gas oil.

We claim:

1. A process for making a lubricant oil of low pour point which comprises a) catalytically dewaxing a lube boiling range feedstock in the presence of hydrogen over a dewaxing catalyst comprising an intermediate pore size zeolite having the structure of ZSM-5 in the hydrogen or decationized form, during which dewaxing the temperature is progressively increased to maintain a substantially constant product pour point to produce a lubricant oil product of improved oxidation stability, b) thereafter catalytically dewaxing a light distillate lube boiling range feedstock in the presence of hydrogen over said dewaxing catalyst; c) thereafter exposing said dewaxing catalyst to hydrogen reactivation conditions, and d) thereafter repeating step a).

2. The process according to claim 1 in which the dewaxing cycle is carried out over a temperature range of 525° to 725° F., said heavy lube boiling range feedstock is selected from the group consisting of Heavy Neutral and Bright Stock, and said light distillate lube boiling range feedstock is Light Neutral.

3. The process according to claim 1 in which said heavy lube boiling range feedstock is sequenced during a dewaxing cycle in the order of Heavy Neutral and Bright Stock.

4. The process according to claim 1 which is carried out at a hydrogen pressure of 200 to 3000 psig, a temperature of 525° F. to 725° F. and a space velocity of 0.20 to 5.0 LHSV.

5. The process according to claim 1 wherein said feedstocks comprise distillate lube boiling range feedstocks.

6. The process according to claim 5 wherein at least one of said feedstocks is a raffinate.

7. The process according to claim 1 wherein said heavy lube boiling range feedstock is characterized by a 50% boiling point of greater than 850° F. and a kinetic viscosity at 100° C. of greater than 9 centistokes, and said light distillate lube boiling range feedstock is characterized by a 50% boiling point of less than about 850° F. and a kinetic viscosity at 100° C. of less than 9 centistokes.

8. The process according to claim 1 which comprises dewaxing said light distillate lube boiling range feedstock for at least 2 days.

9. The process according to claim 1 which comprises dewaxing said light distillate lube boiling range feedstock for at least 30 days.

10. The process according to claim 1 wherein said hydrogen reactivation is carried out at 800° to 1100° F. for 4 to 30 hours at 100 to 3000 psig $H_2$.

11. The process according to claim 1 wherein said hydrogen reactivation is carried out at 900° to 1000° F. for 16 to 20 hours at 350 to 500 psig $H_2$.

12. A process for making a lubricant oil of low pour point and improved oxidation stability from lube boiling range feedstock which comprises a) catalytically dewaxing a relatively heavy lube boiling range feedstock characterized by a 50% boiling point of greater than 850° F. and a kinetic viscosity at 100° C. of greater than 9 centistokes in the presence of hydrogen over a dewaxing catalyst comprising an intermediate pore size zeolite having the structure of ZSM-5 in the hydrogen or decationized form, during a dewaxing cycle in which the temperature is progressively increased to maintain a substantially constant product pour point; b) thereafter catalytically dewaxing a relatively light distillate lube boiling range feedstock characterized by a 50% boiling point of less than about 850° F. and a kinetic viscosity at 100° C. of less than 9 centistokes in the presence of hydrogen over said dewaxing catalyst; c) thereafter hydrogen reactivating said dewaxing catalyst; and d) repeating a) to c) at least once.

13. A process according to claim 12 in which the dewaxing cycle is carried out over a temperature range of 525° to 725° F.

* * * * *